United States Patent [19]

Chapel

[11] 4,088,336

[45] May 9, 1978

[54] FOOT-WEARABLE STILT

[76] Inventor: Lesley Chapel, 9211 Haas Ave., Los Angeles, Calif. 90049

[21] Appl. No.: 748,489

[22] Filed: Dec. 8, 1976

[51] Int. Cl.[2] ..... A63C 17/00

[52] U.S. Cl. ..... 280/11.19; 36/81; 280/11.36; 272/70.1

[58] Field of Search ..... 280/11.3, 11.19, 11.36, 280/11.37 E; 36/81; 272/70.1

[56] References Cited

U.S. PATENT DOCUMENTS

| | | | |
|---|---|---|---|
| 327,374 | 9/1885 | Zack et al. | 280/11.36 X |
| 1,930,363 | 10/1933 | Knox | 280/11.3 UX |
| 2,172,000 | 9/1939 | Wenker | 280/11.36 X |
| 2,223,384 | 12/1940 | Pecorella et al. | 36/81 |
| 2,301,702 | 11/1942 | Hite et al. | 36/81 |
| 3,201,876 | 8/1965 | Leumi | 36/81 UX |
| 3,976,293 | 8/1976 | Lavreta | 36/81 X |

*Primary Examiner*—Joseph F. Peters, Jr.
*Assistant Examiner*—Gene A. Church
*Attorney, Agent, or Firm*—Howard L. Johnson

[57] ABSTRACT

A pair of elevating structures to be worn on the feet, each of the structures comprising a ground contact unit to which a vertically separated foot receiving unit is joined to form a unitary structure. The ground contact unit has a longitudinal base plate from which rear, side, and front walls extend upwardly to form a hollow structure, a portion of these walls extending further upward in the form of a hollow tower on the rear portion of the unit to which tower the foot receiving unit is joined. The tower extends under the rear half of the foot receiving unit so that the weight of the water is centered over the tower and transferred from the tower to the ground contact unit. The forward part of the foot receiving unit is cantilevered from the tower and forms an open area between the forward portion of the foot receiving unit and the lower part of the ground contact unit. The foot receiving unit has semi-flexible walls and means to close the walls about the feet of the wearer. In one embodiment, the undersurface of the base plate is concave to provide edges for gripping the ground surface. In another embodiment, a pair of rollers are attached at the respective ends of the base plate, the rollers at the forward end of the base plate being positioned beyond the forward extension of the foot receiving unit.

3 Claims, 5 Drawing Figures

FOOT-WEARABLE STILT

BACKGROUND OF THE INVENTION

In the past, stilts have served chiefly as an amusement or recreational device, and to a lesser extent as instruments for developing a particular skill, namely, the proficient use or performance with stilts, such as ehibited by circus performers. Children have been intrigued by such a plaything which offered the possibility of walking about while standing high off the ground. However, the fact remains that the necessity of both manually manipulating and (by body movement) balancing one's shifting weight on successive, unsteady, essentially point-contacts with an uneven and distant ground surface, cannot avoid the characterization of such structure being a dangerous device which demands both slowly-acquired skill and continued practice and concentration. Alternately, "elevator" shoes which have utility when intended for regular use, are necessarily limited to producing a comparatively small elevation, for one reason in order to try to conceal that their added structure is not that of the wearer himself.

BRIEF STATEMENT OF THE INVENTION

In contrast, the present invention provides a pair of light-weight, stilt or elevation-structures which can be worn, one attached to each foot like shoes or sandals, and by which the wearer (without manual involvement) can fairly easily and relatively safely walk or glide (roll) about while remaining supported at an appreciable elevation such as 8 to 12 inches. Even with one form having groundcontact rollers, the "rider" can still maintain his essentially normal balance or stability. This is in marked contrast, for example, to the rider of a skateboard (who is almost required to wear deck shoes or be barefoot). In addition, even with the present device strapped to his feet, the wearer can stand up from a prone position on the floor or ground, similar to a person wearing ordinary roller skates.

Use of the present roller construction will develop the wearer's ankle muscles and provide a safer pre-training for the use of ordinary roller skates, if such is desired. Either with or without the ground rollers, such device will amuse children by the fantasy of wearing "giant boots" or taking "giant steps," or performing a "moon walk."

In addition to its play-use for the young, in either form —with or without rollers —an adult can employ the present device to perform numerous useful tasks which require his elevation above the ground level and especially those which require his moving about at such level; for example, attaching ceiling-high draperies, painting or plastering a ceiling, arranging articles along the length of a high shelf, waxing the top of an automobile roof, hanging pictures, etc. By standing sidewise, while wearing the present device, one can even climb stairs or mount a stepladder.

Structurally, there is provided an upper foot-length platform having foot-attachment means (which may be a boot formed integral with the stilt or tower and thus providing additional ankle support). Beneath the platform is a longer base plate which also extends laterally beyond each side edge of the foot support. The platform and base plate are vertically separated and fastened together by a stilt-like tower which is hollow and extends from a heel line forward approximately half the length of the foot, thus leaving an open space in front of it beneath the forward half of the foot and the base plate beneath it. This opening enhances the novelty effect of the "giant boot," but also enables the whole to be fabricated with a total light weight, the encircling support walls or tower preferably being formed of synthetic resin or plastic. In addition, by providing an essentially planar ground-contact, with the forward plate-end or its roller pair being located beyond the front edge of the wearer's foot or shoe, and by having the rear edge of the base plate or its pair of rollers located on a vertical line with the wearer's heel, the wearer can achieve longer than usual steps without changing his ordinary stride-length.

With the non-roller form, the lower ground-contact surface is somewhat concave so as to form a longitudinal ridge along each side which further reduces the chance of tipping sideways. Aside from its play value, this form is useful in moving about a flooded basement or other area.

DETAILED DESCRIPTION OF PREFERRED FORMS

Figure 1:
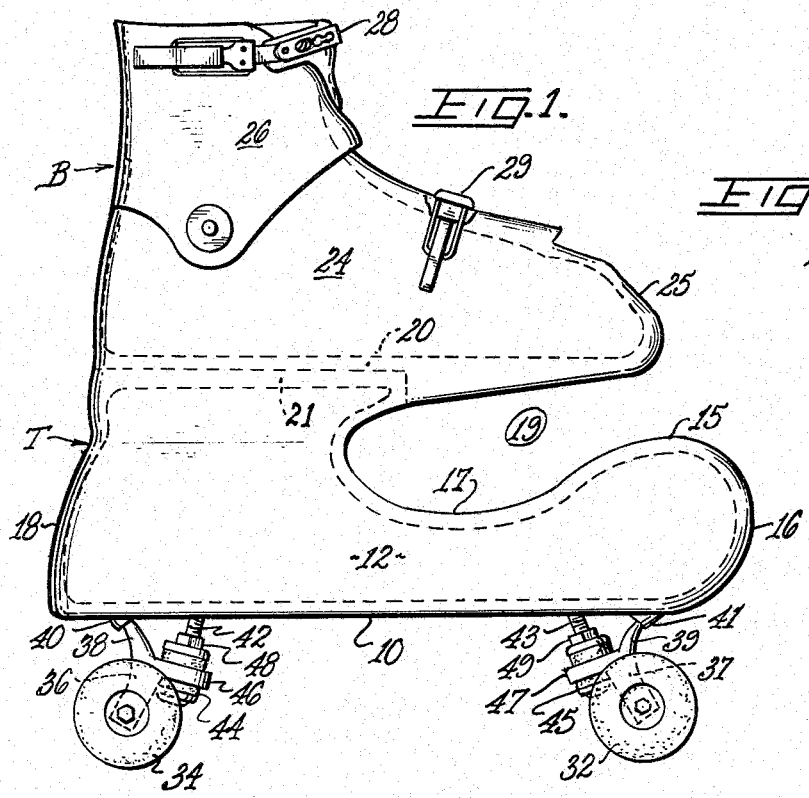
FIG. 1 is a side elevational view of the roller and boot form of my device.
Figure 2:
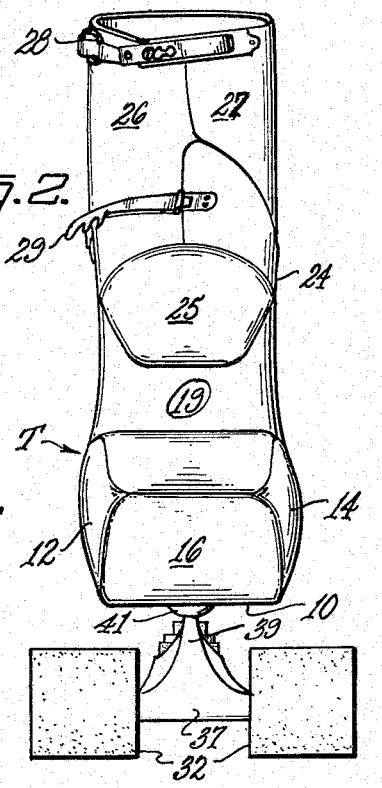
FIG. 2 is a front elevation viewed from the right of FIG. 1.
Figure 3:
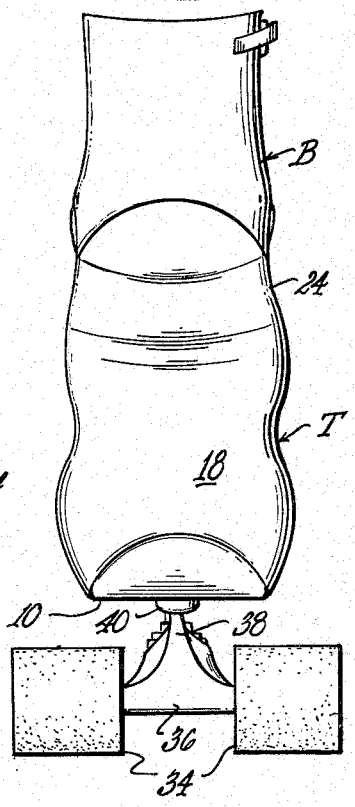
FIG. 3 is a rear elevational view from the left of FIG. 1.

The construction of FIGS. 1–3 provides a lower, completely enclosed or hollow tower or body T to which an upper boot structure B is fixedly secured, the two being simultaneously fabricated or joined together so as to form a substantially unitary structure or assembly. Basically there is an elongated, planar, generally horizontal base plate 10, from the respective edges of which, side 12, 14, front 16 and rear 18 walls arise to join a platform or foot support 20 which is generally parallel to and of lesser length than the base plate 10. From a forward crest area 15, the front wall 16 curves rearward to form a trough 17 which generally delineates an open or "cut out" area 19 which underlies approximately the area of the forward half of the wearer's foot or boot. Thus the vertical column extending from the rear portion of the base plate 10 to the rear half 21 of the foot support platform 20 may be considered the equivalent of a (short) length, which is in general vertical alignment with the wearer's ankle, leg, and the thus-supported half of his torso. However, stability is imparted to the elementary stilt form, by forward extension of the base plate as well as a small lateral extension to each side of the actual foot support area. The hollow tower T including the base plate 10 and platform 20 may be blow-molded of synthetic plastic or resin by known technique, or alternately, fabrication may begin with a pair of planar surfaces 10, 20 which are then rigidly connected or braced together by upright support members or walls.

From the periphery of the platform 20, which may form the sole of a shoe or boot, arise conventional semi-flexible walls 24 of the footwear, extending from a toe area 25 to a pair of ankle flaps 26, 27 which may be selectively fastened together by conventional clasp means 28, 29 and/or by lacings.

Along the underface of the base plate 10 are mounted a forward 32 and rear 34 pair of rollers, each connected along the longitudinal midline of the base plate by an inverted-T-shape bracket plate 36, 37, the cross arms of which retain an axle which carries the respective rollers. The upper end of the T is formed as a cylindrical stud 38, 39 which is loosely received in a corresponding socket of an attachment knob 40, 41. Dependent from the plate 10 is a threaded shaft 42, 43 which loosely traverses an axially compressible bushing 44, 45 which is medially held by a supporting ring 46, 47 extending laterally from the bracket plate. The bushing is tensioned by a nut 48, 49 carried by the respective shaft, thus determining the amount of possible lateral play of the T-bracket and its rollers. Such roller mounts are well known in connection with conventional skate boards.

Figure 4:
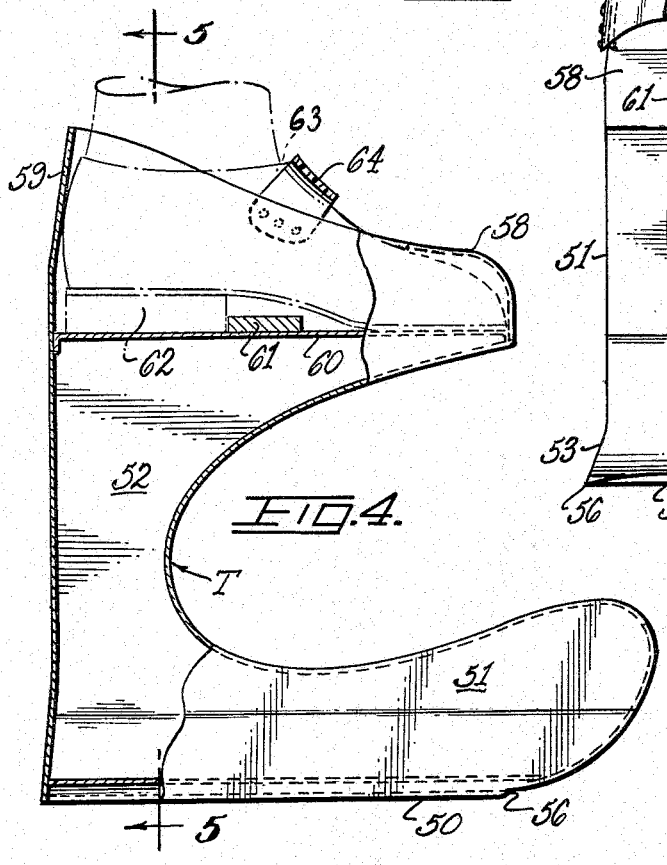
FIG. 4 is a side elevational view of the non-rollable form of the foot-wearable device.
Figure 5:
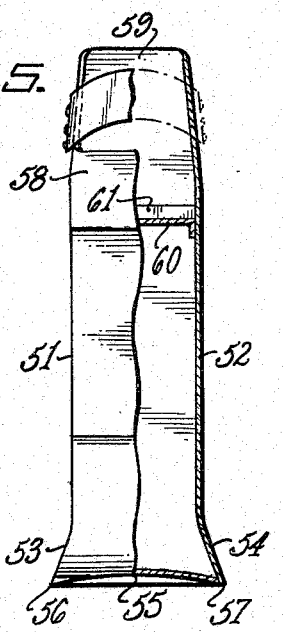
FIG. 5 is a transverse sectional view taken along line 5—5 of FIG. 4 with some parts shown in elevation.

The non-roller construction of FIGS. 4–5 has an elongated base plate 50, vertically connected to a shorter length platform 60 by upright side walls 51, 52, which along their lower longitudinal margins are outslanted 53, 54, by a few degrees so that in conjunction with a small bowing or concavity 55 of the base plate, they provide longitudinal ground-contact edge ridges or ribs 56, 57 (FIG. 5) which increase the stability and ease of walking.

Above the foot-support platform 60 there is a shoe-retaining socket formed jointly by a toe-pocket 58, an inbowed heel cavity 59, and a cross rib 61; the latter serves as a forward abutment for the heel 62 of the wearer's footpiece 63, while a cross strap 64 is disposed to overlie the shoe or sandal and retain it in the socket. Such an open, footpiece socket can also be formed with the roller construction of FIGS. 1–3, and similarly the integral boot feature of FIGS. 1–3 can also be incorporated in the construction of FIGS. 4–5.

I claim:

1. A pair of elevating structures to be worn on the feet, each of said structures comprising a ground contact unit to which a vertically separated foot receiving unit is joined to form a unitary structure;

said ground contact unit having a horizontal base plate from which rear, side, and front walls extend upwardly to form a hollow structure, a portion of said walls further forming a hollow tower on the rear portion of said unit to which said foot receiving unit is joined, said tower extending forward under said receiving unit from the rear of said base plate approximately half the length of said receiving unit, the center line of said tower being in vertical alignment with the leg of the wearer whereby the weight of the wearer is received by the tower and transferred to the ground contact unit, the fore part of said receiving unit being cantilevered from said tower to form an open area between said fore part and the fore portion of said ground contact unit, the base plate further extending forward of the front end of said receiving unit and laterally of same for stability;

the foot receiving unit being boot-like with means to secure the foot of the wearer within said foot receiving unit.

2. A structure according to claim 1 wherein the undersurface of the horizontal base plate has a concavity so as to form sharp edges around the periphery of the base plate undersurface.

3. The structures according to claim 1 wherein each end of the base plate carries roller means, including means for lateral tilting of the base plate to either side relative to the roller means in response to body movement of a wearer, the roller means mounted on the forward end of the base plate being positioned forward of the forward end of the foot receiving unit.

* * * * *